US005385490A

United States Patent [19]

Demeter et al.

[11] Patent Number: 5,385,490

[45] Date of Patent: Jan. 31, 1995

[54] MODULAR CONNECTOR FOR USE WITH MULTI-CONDUCTOR CABLE

[75] Inventors: Michael L. Demeter, Vernonia; Robert F. Stanton, Lake Oswego, both of Oreg.

[73] Assignee: The Whitaker Corporation, Wilmington, Del.

[21] Appl. No.: 111,642

[22] Filed: Aug. 24, 1993

[51] Int. Cl.[6] ..... H01R 17/04

[52] U.S. Cl. ..... 439/579; 439/289; 439/540

[58] Field of Search ..... 439/540, 284, 289, 290, 439/292, 293, 736, 885, 886, 579

[56] References Cited

U.S. PATENT DOCUMENTS

| | | | |
|---|---|---|---|
| 3,605,068 | 9/1971 | Rayburn | 439/291 |
| 4,087,655 | 5/1978 | Massey | 179/175 |
| 4,243,289 | 1/1981 | Kozel | 339/126 |
| 4,484,792 | 11/1984 | Tengler et al. | 339/143 |
| 4,602,831 | 7/1986 | Lockard | 439/736 |
| 4,865,562 | 9/1989 | Burg et al. | 439/885 |
| 5,060,372 | 10/1991 | Capp et al. | 439/885 |
| 5,108,313 | 4/1992 | Adams | 439/610 |
| 5,163,835 | 11/1992 | Morlion et al. | 439/886 |
| 5,176,541 | 1/1993 | Mori | 439/736 |
| 5,274,917 | 1/1994 | Corbett, III et al. | 29/860 |
| 5,277,592 | 1/1994 | Morlion | 439/886 |

*Primary Examiner*—David L. Pirlot

[57] ABSTRACT

A small, high-contact density connector, and a method for manufacturing such a connector for reliably and quickly connecting many small conductors such as coaxial conductor pairs of a flexible cable to respective terminals in a planar array. Sets of conductive strips jacketed by molded plastic insulating material have cable conductor terminals at one end and contact surfaces exposed at the opposite end, as connector modules. Several modules are held together, defining a connector mating face with a closely-spaced array of contact surfaces, and anisotropically conductive connector sheet material is used between the connector mating face and an array of conductor terminals to which the conductors are being connected.

10 Claims, 5 Drawing Sheets

MODULAR CONNECTOR FOR USE WITH MULTI-CONDUCTOR CABLE

FIELD OF THE INVENTION

The present invention relates to electrical connectors, and particularly to connectors for interconnecting many conductors, as of a multi-conductor cable, to an array of circuit conductor terminals.

BACKGROUND ART

It is desirable in certain situations to be able to connect electrical devices through the use of flexible cables, in such a manner that a cable can easily be separated from a circuit module and reconnected thereto or to a similar circuit module. In some cases such cables may contain many conductors or coaxial pairs of conductors, each of very small size, while it is necessary, nonetheless, to achieve reliable electrical interconnection of each conductor with the circuit module, and to do so without the connector having a significant effect on the impedance of the combination of the cable and the circuit module. At the same time, it is commonly desired for the size of an electrical connector to be no greater than is necessary consistent with reasonable cost and difficulty in assembly thereof.

Particularly where many conductors of a flexible cable connected to larger, stationary, portions of complex electronic devices are to be connected to portable electrical circuit modules such as hand-held signal input or output devices, it is desirable to minimize the size of cable connectors, so that the connectors do not unnecessarily impose restrictions on the convenience of use portable of the circuit modules. For example, it is desirable to allow as much freedom of movement as is practical for a hand-held transducer module connected by a cable, including as many as one hundred or more coaxial conductor pairs, to a stationary control and display console of a diagnostic medical ultra-sound apparatus.

It has previously been costly to design small connectors to fit cables for specific cables and circuits, adding greatly to the cost of each unit where there are only relatively small numbers produced. It is therefore desirable to minimize the cost to design and manufacture a multi-conductor connector specifically intended for a particular application, where a cable to be connected includes many conductors of a particular size and the connector is to be as small as practical.

Many developments have been made to provide small connectors with high contact density and reliable performance. For example, Adams U.S. Pat. No. 5,108,313 discloses a modular connector for multi-conductor cables, in which respective groups of conductors of a cable are attached to each of several modules each carrying a corresponding number of pin contacts. The modules are clamped together and held in a predetermined arrangement by a housing which unifies the several modules as an integral connector. The individual conductors of the cable, however, are spread apart from one another within the connector modules and the housing, and the connector therefore is larger than is desirable, as a result of the pin contact spacing.

Tengler et al. U.S. Pat. No. 4,484,792 discloses another modular electrical connector including spring contacts located within sockets. The individual conductors of a cable connected using the connector are spaced somewhat apart from each other to achieve connection to the connector. Thus, the connector disclosed is larger than desirable and does not provide as high a contact density as is desired in some applications.

Kozel U.S. Pat. No. 4,243,289 discloses a modular connector in which an array of contact pins includes several similar modules each containing a group of the contact pins. The contact pins, however, are spaced apart farther than is desirable for a high-density connector in a situation where space is limited or small size is highly desirable.

Mori U.S. Pat. No. 5,176,541 discloses a connector incorporating brass strips formed on a carrier and thereafter partly covered with plastic material molded onto the strips. The plastic material holds and supports portions of the brass strips, leaving other portions exposed as contacts, but with electrical contact being available only along exposed lateral faces of contact portions of the strips. The connector, moreover, is not well adapted to connecting a cable to a grid-like planar array of terminals as may be present on a printed circuit board.

Massey U.S. Pat. No. 4,087,655 discloses a connector including several modules to which pairs of conductors can be connected. The connector defines receptacles for pin contacts opposite the connected conductors, but does not provide contact density as high as is desired for some applications such as those mentioned previously.

What is desired, then, is a connector and a method for manufacturing such a connector to provide a high contact density, for achieving connection of all of the conductors of a multi-conductor cable to respective terminals of conductors of a circuit module in a minimum amount of space, but without the connector being overly expensive to manufacture. It is also desired to provide such a connector which may readily be manufactured in various sizes, to connect cables including various numbers of conductors of various sizes to corresponding arrays of terminals.

SUMMARY OF THE INVENTION

The present invention overcomes the aforementioned shortcomings of the prior art and provides a connector, and a method for manufacturing such a connector, in which a high contact density is provided, for connecting large number of electrical conductors such as the conductors or coaxial conductor pairs included in a flexible cable, to an array of conductor terminals provided in a small area, such as on a printed circuit board which is part of a circuit module.

In accordance with the present invention, a set of conductive strips, attached to a base as part of a unit, is jacketed by an electrically insulative material, leaving exposed a respective conductor terminal portion of each of the conductive strips. Thereafter, the conductive strips are separated from the base, and the insulative material is shaped to define a junction face of a connector module and to expose a connector contact surface of each of the conductive strips. A plurality of the connector modules are aligned with each other and held together to define a connector mating face including the junction face of each of the connector modules and exposing the connector contact surfaces in an array.

In use of the connector the conductor mating face is urged into contact with terminal pads located in a corresponding array, as on a printed circuit.

In one embodiment of the invention a layer of anisotropically conductive elastomeric connector material is interposed between the connector mating face and the array of conductor terminals.

According to one embodiment of the method of the invention, the conductors of a multi-conductor cable are grouped and the conductors of each group are fastened together in a ribbon-like array. Each conductor of such an array is connected electrically, as by soldering, to the conductor terminal portion of a respective one of the conductive strips of a module, and after each module has thus been connected to the respective ones of the conductors of the cable all of the modules are installed in a retainer in proper relationship to one another to form the mating face of the connector.

In one embodiment of the connector according to the invention a bus bar is defined between a pair of the conductive strips and extends adjacent the conductor terminal portions of others of the conductive strips as a terminal for connection of the common-potential Shield conductors of the several coaxial pairs of conductors of a cable.

It is a feature of the present invention that the sets of conductive strips can easily be produced in sizes providing a desired pitch between conductive strips, a desired number of conductive strips for each connector module, and desired dimensions of each conductive strip to provide an appropriate contact surface area of each contact exposed in the connector mating face. Thus, the invention facilitates provision of a connector including enough modules of the proper size to provide for connection of a particular number of conductors of a given size contained in a cable.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
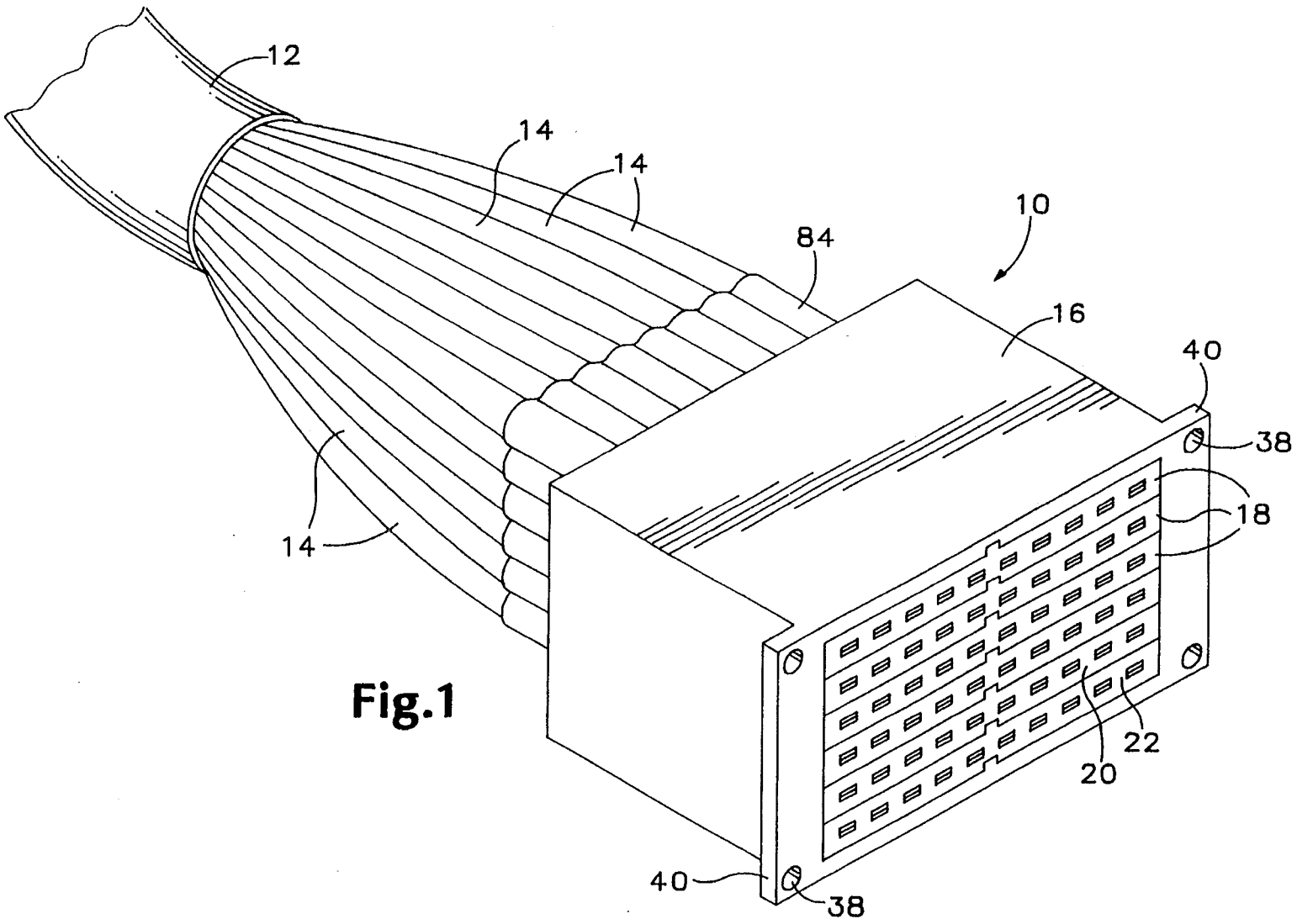
FIG. 1 is a perspective view of a connector embodying the present invention, with a multi-conductor cable connected thereto.
Figure 2:
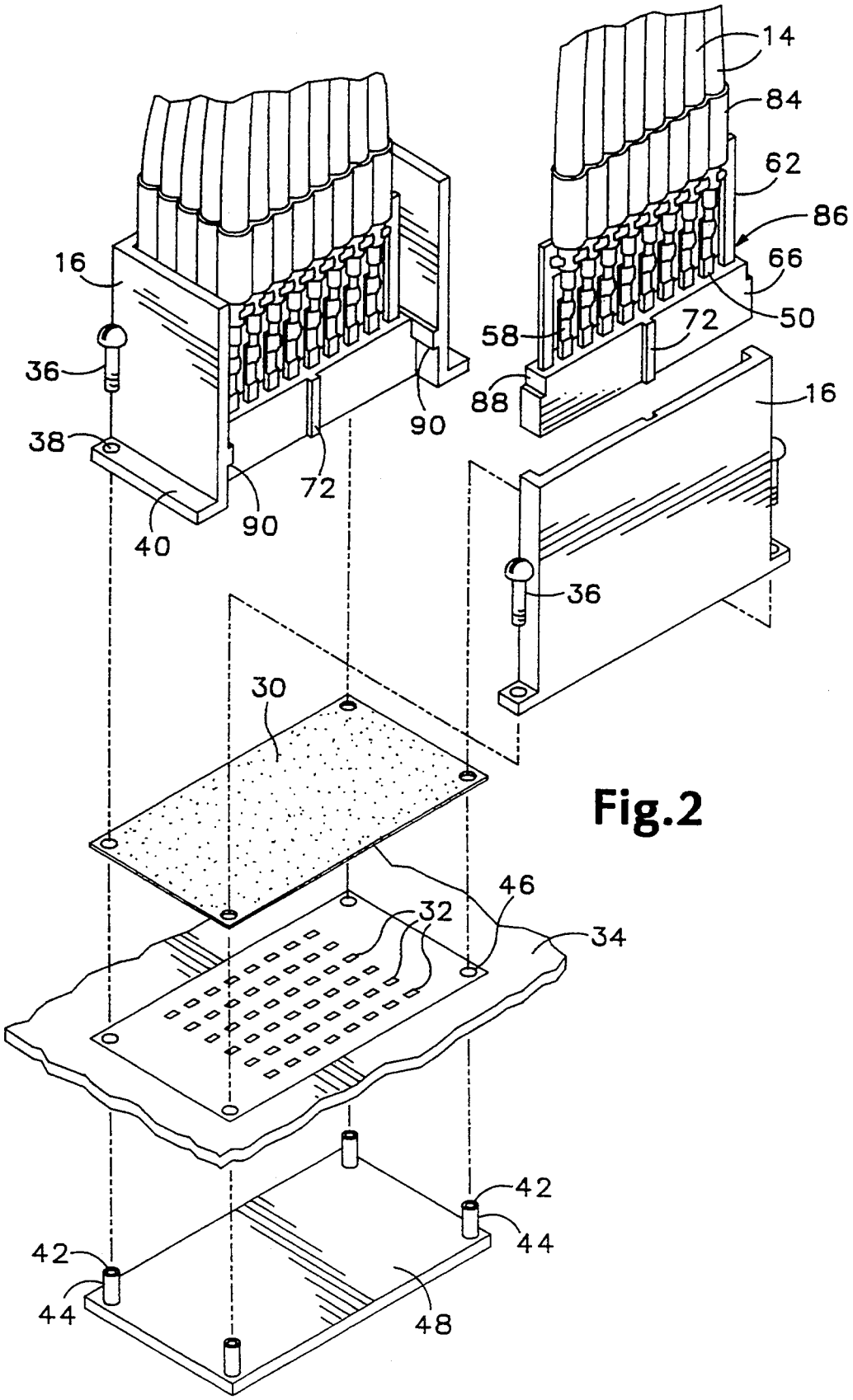
FIG. 2 is an exploded and partially cut-away view of the connector shown in FIG. 1, in use to connect the cable to an array of contacts.

Referring now to the drawings which form a part of the disclosure herein, a connector 10 is shown in FIGS. 1 and 2, together with a portion of a multi-conductor cable 12 including many individual insulated coaxial conductor pairs 14.

A housing or retainer 16 holds several connector modules 18 which are aligned with one another to form a connector mating face 20 incorporating a junction face 22 of each connector module 18, located at a junction end of each module 18.

Several of the coaxial conductor pairs 14 are connected to each connector module 18 at a cable termination end 24 thereof, and a respective connector contact 26 corresponding to the signal conductor of each coaxial part 14 is exposed in the module junction face 22 at the junction end of the module 18.

A sheet 30 of an anisotropically conductive elastomeric connector material is located between the connector mating face 20 and an array of conductor terminals 32 for the conductors of a circuit board 34. Such material is well known and a suitable material is available, for example, from Shin-Etsu Polymer America, Inc. of Union City, Calif., as its MAF-connector material.

The retainer 16 is attached to the circuit board 34 by fasteners such as screws 36 passing through respective holes 38 defined in flanges 40 and engaged in threaded bores 42 defined in alignment pins 44 extending through bores 46 defined in the circuit board 34. Optionally, a stiffener plate 48 may be provided to fit against the opposite side of the circuit board 34, depending upon the structure of the circuit board 34. The screws 36 and alignment pins 44 thus hold the connector 10 tightly, urging the mating face 20 into electrical contact against the sheet 30 of anisotropically conductive connector material, with each of the connector contacts 26 aligned with a corresponding one of the conductor terminals 32 to effect electrical interconnection through its thickness of each of the signal conductors of the coaxial conductor pairs 14 with the appropriate terminal 32 contained in the circuit board 34 while insulating the adjacent conductive paths so established from each other.

Each of the connector modules 18 is manufactured according to the method of the invention by first producing a plurality of conductive strips 50 in the form of a unit 52 resembling a lead frame such as those used in connecting integrated circuits to carriers. A sheet of conductive metal, such as copper alloy of the proper thickness, is shaped to form a plurality of such units 52 resembling lead frames, with each unit 52 including a base 54 from which extend a number of conductive strips 50 equal to the number of cable conductors or coaxial conductor pairs 14 intended to be connected to each connector module 18.

The units 52 may be produced by conventional methods, the appropriate method being chosen largely according to the size of the connector 10 to be produced, with the pitch 56 between adjacent conductive strips 50 determining whether mechanical die stamping, photoresist chemical etching, or machine-controlled laser cutting techniques are most appropriate and economical. The pitch 56 may be as great as 2.5 mm, for example, or less than 0.5 mm, depending on the size of the conductors of the cable concerned and the capability of the anisotropic elastomeric conductor material to provide discrete connections.

Each of the conductive strips 50 includes a conductor terminal portion 58. A bus bar 60 is spaced apart from the conductor terminal portions 58 and extends transversely along the group of them. A pair of conductive strips 62 extend from the base 54 to the bus bar 60, parallel with the conductive strips 50, and support the bus bar 60, so that the conductive strips 50 and 62 and the bus bar 60 are all coplanar with the base 54.

A jacket 66 of an electrically insulative material such as a plastic is molded around a portion of the unit 52 to surround a portion of each of the conductive strips 50 and 62, between the base 54 and the conductor terminal portions 58. Preferably, a strong, rigid plastic such as a glass-filled liquid crystal polymer with a high modulus of elasticity and excellent dimensional stability is used. For example, thermoplastics available from Hoechst-Celanese Corporation of Chatham, N.J., under the designations Vectra E130 or Vectra C130, or from Philipps 66 Company of Bartlesville, Okla. under the designation Ryton, are suitable. The plastic can be injection-molded around the unit 52, in manufacturing a connector module 18 of a larger size, but for the smallest connector modules 18, it is preferred to utilize transfer molding techniques in order to obtain greater precision in the forming of the jacket 66.

The jacket 66 must have precise thickness 68 and width 70, and the unit 52 must be located precisely in the jacket 66, as being centered in the thickness 68 and width 70 of the jacket 66. The jacket 66 preferably includes an alignment rib 72 on one major face and a corresponding alignment groove 74 on its opposite major face to ensure that the modules 18 are aligned and oriented correctly with respect to one another within the connector 10.

Figure 5:
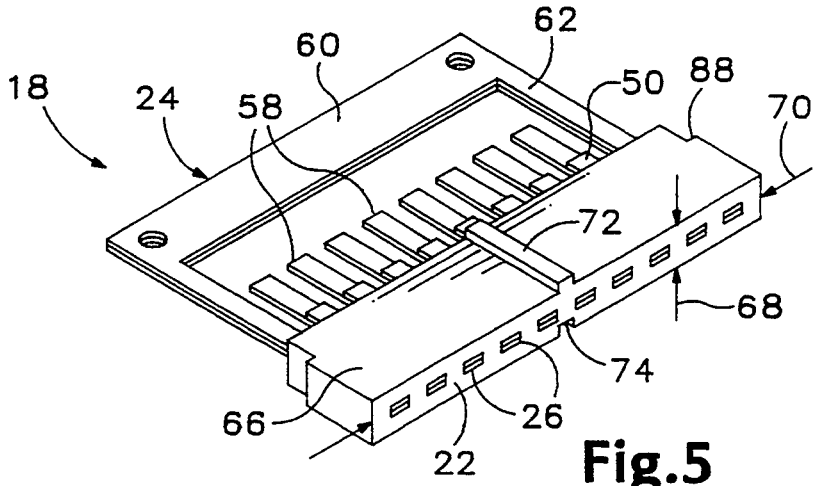
FIG. 5 is a perspective view of the connector module shown in FIG. 4, at a subsequent stage of manufacture thereof.
Figure 7:
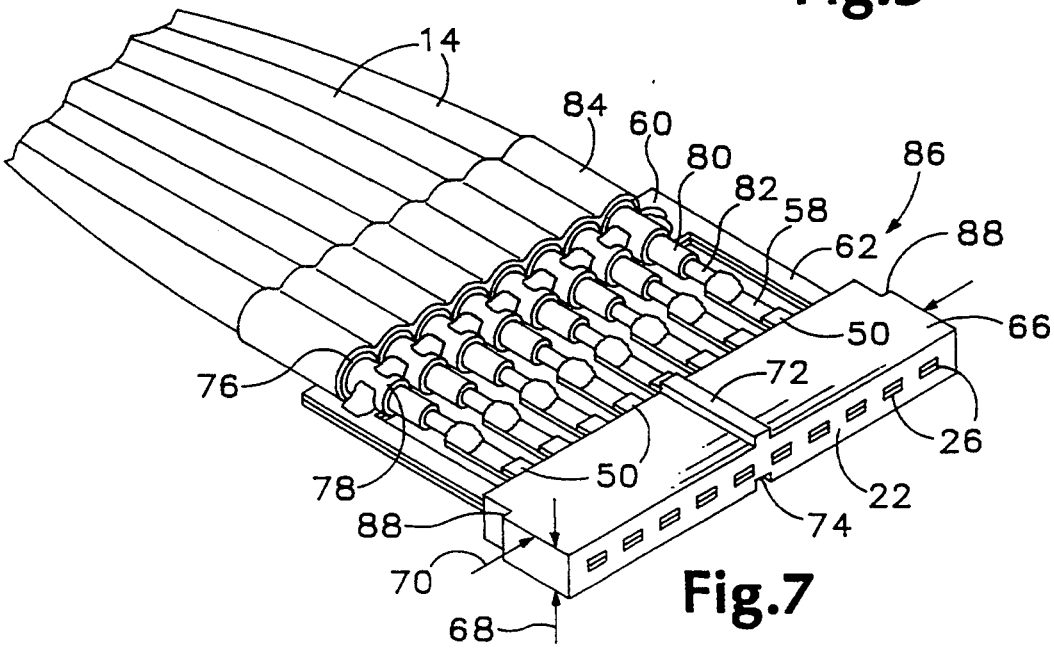
FIG. 7 is a perspective view of a terminated module which is a part of the connector shown in FIG. 1.

Once the jacket 66 has been formed around the conductive strips 50 and 62 it holds them securely in the position in which they were previously maintained in a coplanar array by the attachment of each to the base 54 of the unit 52. Accordingly, once the jacket 66 has been formed and cured, the base 54 may be removed from the conductive strips 50 and 62. This is preferably accomplished in a manner which simultaneously also shapes the jacket 66 at the junction end of the module 18, thus forming the module junction face 22. For example, the conductive strips 50 may be cut by laser machining, simultaneously cutting the jacket 66 to define the module junction face 22, and the module junction face 22 may thereafter be polished mechanically if greater precision is required. Depending on how the base 54 is separated from the conductive strips 50 and 62, the exposed portions remaining at the ends of the conductive strips 50 and 62, after removal of the base 54, are available to be shaped as necessary to form the connector contacts 26. As shown in FIGS. 1, 5, and 7, the connector mating face 20 and the junction faces 22 are planar and are oriented perpendicular to the plane defined by the several conductive strips 50 and 62 of each connector module 18. If desired, to provide improved conductivity and resistance to corrosion, the contacts 26 may be coated, as by providing a plating of gold a few microns thick.

Figure 6:
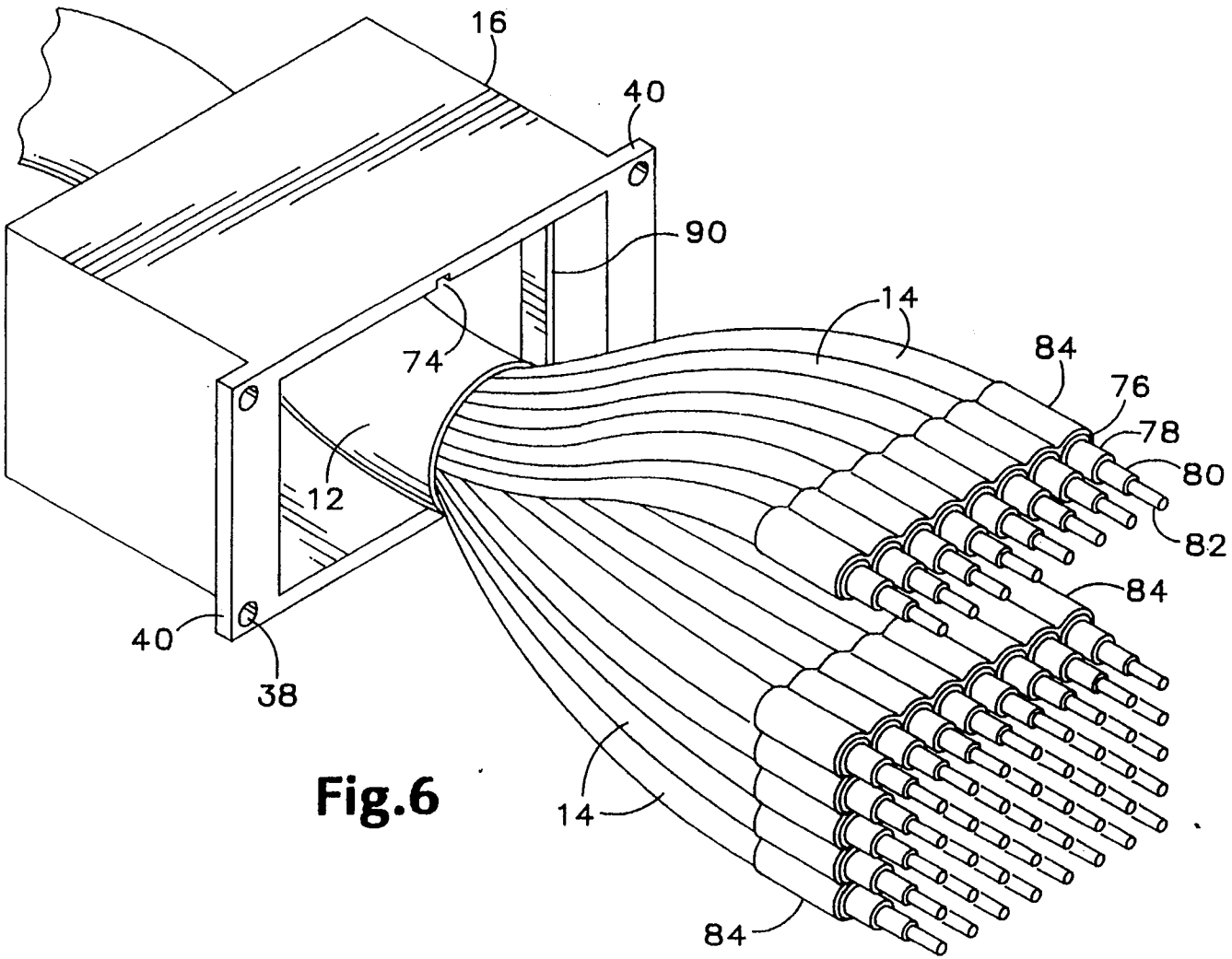
FIG. 6 is a perspective view of an end of a multi-conductor cable prepared for connection with the connector shown in FIG. 1.

As shown best in FIGS. 6 and 7, in order to connect the cable 12 to the connector 10 the individual conductors or coaxial pairs 14 of the cable 12 are trimmed to equal lengths and the insulating jacket 76, the shield conductor 78, and the dielectric material 80 surrounding the central conductor 80 are stripped to expose respective portions of each for connection, as shown in FIG. 6. The coaxial conductor pairs 14 are then bound together, as by use of a strip of an adhesive tape to hold the terminal portions of the conductor pairs 14 in ribbon-like groups 84 equal in number of individual conductors or coaxial conductor pairs 14 to the number of conductive strips 50 of each module 18 of the connector 10. Preferably, the pitch 56 of the conductive strips 50 in the connector module 18 is equal to the spacing between the central conductors 82 of the coaxial conductor pairs 14, in a group 84, with the insulating jackets 76 lying alongside and substantially in contact with one another as shown in FIG. 6, in order to minimize the size of the connector 10 and achieve the maximum practically useful contact density.

The retainer 16 is placed over the cable 12 as shown in FIG. 6, and thereafter each ribbon-like group 84 of coaxial conductor pairs 14 of the cable 12 is connected, as by soldering the central conductor 82 thereof to a respective one of the conductor terminal portions 58 and soldering each shield conductor 78 to the bus bar 60, thus producing a set of terminated connector modules 86 such as the one shown in FIG. 7. Alternatively, the connections of the conductors 78 and 82 could be accomplished by electric welding, laser welding, or conductive epoxy adhesives.

When all of the conductors or coaxial pairs 14 of the cable 12 have been connected to their respective connector modules 18 all of the terminated conductor modules 86 thus completed are inserted into the retainer 16, where the alignment ribs 72 of the jackets 66 of the modules 18 and the retainer 16 mate with corresponding grooves 74 of the other jackets 66 and of the retainer 16. This aligns the connector contacts 26 of each module 18 laterally with those of adjacent modules 18.

Shoulders 88 defined by the jacket 66 of each module 18 are supported by a ledge 90 defined within the retainer 16 as a reference for the longitudinal position of each module 18. All of the modules 18 are held tightly together by the retainer 16 to maintain close spacing between adjacent ones and to maintain the position of each within the retainer 16, establishing a grid-like array of connector contacts 26 in the connector mating face 20. Preferably, each of the module junction faces 22 is prepared at a precisely established distance from the shoulders 88, and the connector mating face 20 is thus established with sufficient precision by inserting the modules 18 into the retainer 16. Alternatively, the modules 18 can be mounted in the retainer 16 and fastened there by an adhesive, and a final shaping of the junction face can be performed thereafter using suitable abrasives or laser machining techniques.

Figures 3, 8, 9:
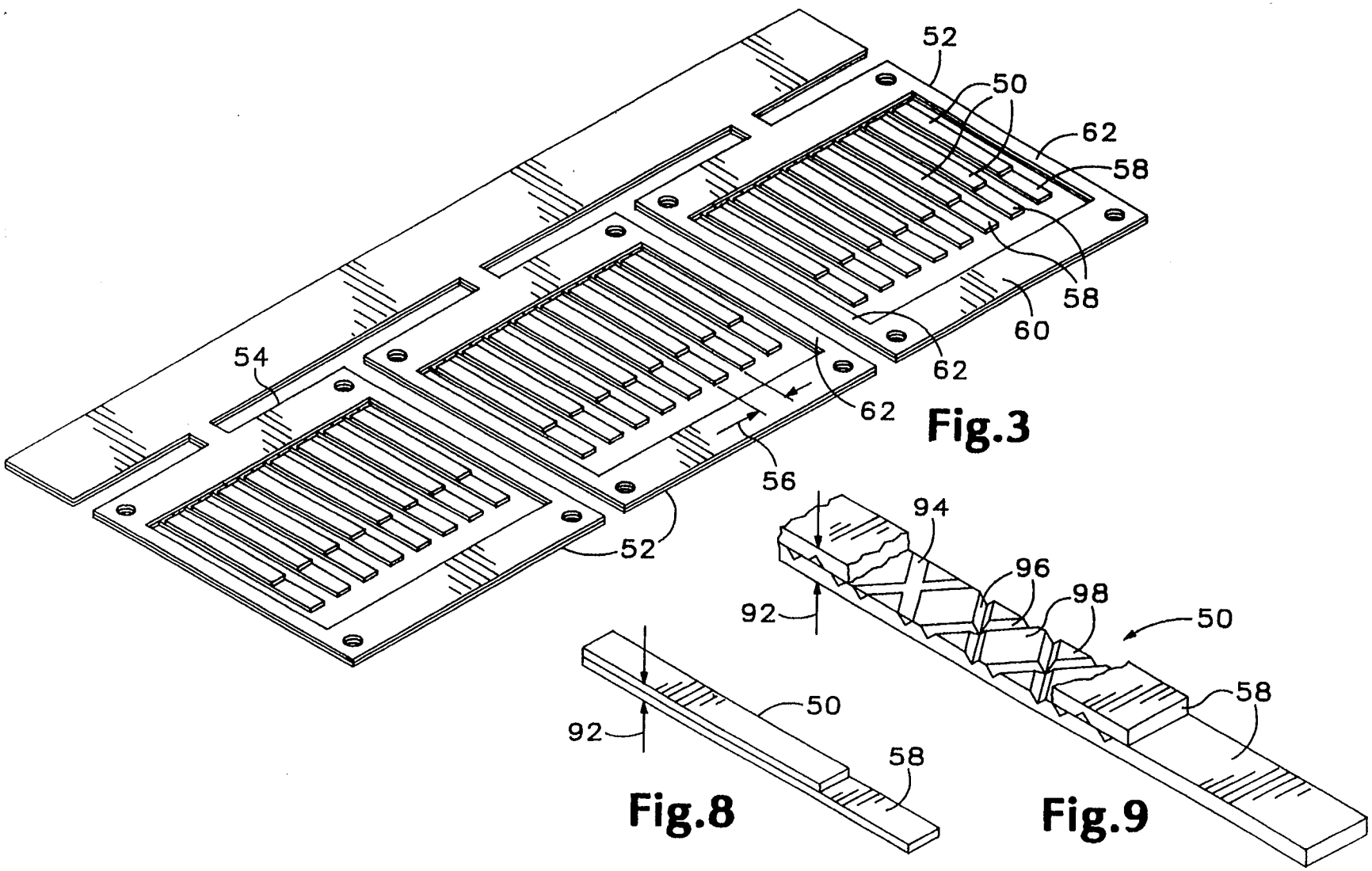
FIG. 3 is a perspective view of a part of a thin sheet of metal defining a plurality of sets of conductive strips which form parts of the connector shown in FIG. 1.
FIG. 8 is a perspective view of a portion of a laminated conductive strip forming part of a connector such as that shown in FIG. 1, at an enlarged scale.
FIG. 9 is a partially cut-away view of part of the laminated conductive strip shown in FIG. 8, at a further enlarged scale.
Figure 4:
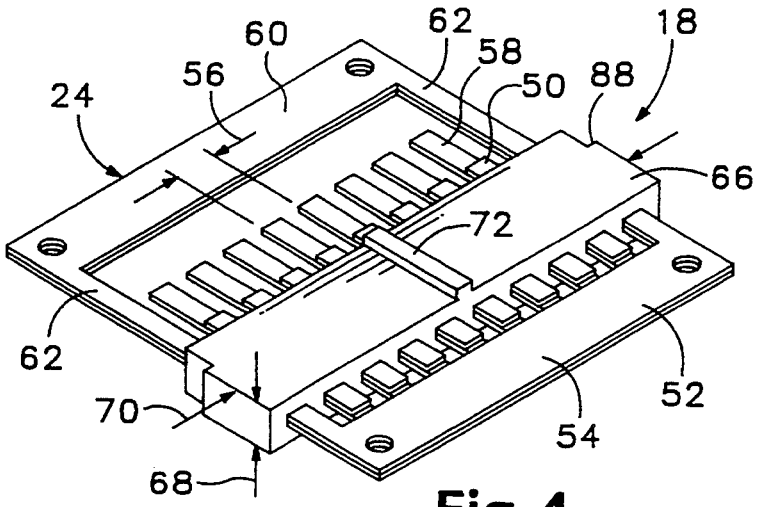
FIG. 4 is a perspective view of a connector module forming a part of the connector shown in FIG. 1, at an intermediate stage of manufacture thereof.

As shown in FIGS. 8 and 9, in order to provide a greater area in each of the connector contacts 26, the conductive strips 50 and 62 may be manufactured to have a greater thickness 92, by laminating two or more units 52 prior to formation of the jacket 66. The units 52 are aligned precisely with one another and held together by an adhesive material 94, which desirably has exceptionally high shear and peel strength. For example, a thermosetting liquid structural adhesive such as Scotch-Weld TM 2290 Epoxy Adhesive/Coating available from the 3M Company of Minneapolis, Minn. is suitable. The adhesive/coating mentioned is applied as a film coating which dries to a tack-free surface and may be cured later by application of bonding pressure and heat to provide a metal-to-metal bond. Preferably, a film of such adhesive having a thickness in the range of 2.5–10 microns is preferred for the purpose of laminating units 52 to provide thicker connective strips 50 and 62.

As shown in FIG. 9, since it is necessary to provide electrical interconnection between the two or more layers of a laminated structure of a connective strip 50 or 62, the adhesive is applied in depressions such as grooves 96 defined in one of the opposed surfaces of layers to be adhesively interconnected in making a laminated conductive strip 50, and the surrounding portions 98 of the layers to be interconnected are held in actual physical contact with one another or with such a thin film of adhesive material 94 between layers that the resistance of the film is negligible. The grooves 96 or equivalent depressions defined in the opposed surfaces of metallic strips to be adhesively interconnected with each other may be formed, depending upon the size of the unit 52, by computer-controlled laser machining, or by chemical etching, for example.

This manner of laminating thin metal parts is generally well known in the manufacture of magnetic recorder heads, and can be carried out by Vacco Industries (a subsidiary of Esco Electronics Corporation), of South El Monte, Calif.

To aid in assuring electrical connection of a signal conductor of a cable 12 to a conductive strip 50 of laminated construction, one of a pair of units 52 being laminated may have the respective conductor terminal portions 58 of its conductive strips 50 extend slightly further, so that a solder connection of a central conductor 82 will effectively make electrical contact with both of the layers of the laminated conductive strips 50.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A connector for use with a multi-conductor electrical cable, comprising:

(a) a plurality of modules each having a cable termination end and a junction end and each including a plurality of conductive strips arranged in a planar array;

(b) a respective jacket of electrically insulative material encasing respective portions of all of said conductive strips of each one of said modules and holding all of said conductive strips of each one of said modules immobile with respect to each other;

(c) a respective conductor terminal portion included in each of said conductive strips of a respective one of said modules, adjacent said cable termination end of the respective one of said modules including each of said conductive strips;

(d) a respective connector module junction face defined at said junction end of each of said plurality of modules, each said conductive strip of a respective one of said modules having a respective connecting surface located in and which is a part of said connector module junction face thereof and said connecting surfaces of said module being located in a linear array at a predetermined distance from one another; and (d) retainer means for holding all of said plurality of modules together in a predetermined relationship to one another with their respective connector module junction faces aligned with one another as a planar connector mating face.

2. The connector of claim 1 wherein said retainer means and said jacket include means for cooperatively preventing said modules from moving in a predetermined direction beyond a predetermined position with respect to said retainer means.

3. The connector of claim 1, each said module including a pair of outer ones of said conductive strips and a bus bar interconnecting said outer ones of said conductive strips.

4. The connector of claim 1, including a layer of anisotropically conductive connector material associated with said connector mating face for interconnecting each of said connecting surfaces individually with a respective conductor terminal.

5. The connector of claim 1 wherein each of said conductive strips is a laminate of at least two layers of conductive material held together by an adhesive material and wherein said connecting surface of each said conductive strip includes a surface of each of said layers.

6. The connector of claim 5 wherein at least one of said layers defines a depression containing a quantity of said adhesive, while an adjacent surface of said one of said layers is in mechanical and electrical contact with another of said layers together with which said one is held by said adhesive.

7. The connector of claim 5 wherein a portion of one of said layers extends beyond another of said layers in said conductor terminal portion of each of said conductive strips.

8. A connector for use with a multi-conductor electrical cable, comprising:

(a) a plurality of modules each having a cable termination end and a junction end and each including a plurality of conductive strips arranged in a planar array;

(b) a respective jacket of electrically insulative material encasing respective portions of all of said conductive strips of each one of said modules and holding all of said conductive strips of each one of said modules immobile with respect to each other;

(c) a respective conductor terminal portion included in each of said conductive strips, adjacent said cable termination end of the respective module including each of said conductive strips;

(d) a respective connector module junction face defined at said junction end of each of said plurality of modules, each said conductive strip of a respective one of said modules having a respective connecting surface located in said connector module junction face thereof and said connecting surfaces of said module being located at a predetermined distance from one another;

(d) retainer means for holding all of said plurality of modules together in said predetermined relationship to one another with their respective connector module junction faces aligned with one another as a connector mating face; and (e) a layer of anisotropically conductive sheet connector material associated with said connector mating face for interconnecting each of said connecting surfaces individually with a respective conductor terminal.

9. The connector of claim 1 wherein said retainer and each of said modules include means for aligning said modules with each other.

10. The connector of claim 9 wherein said retainer and said modules include means for aligning each said module with respect to said retainer.

* * * * *